US007299572B2

(12) United States Patent
Chagnaud

(10) Patent No.: US 7,299,572 B2
(45) Date of Patent: Nov. 27, 2007

(54) IRONING BOARD

(76) Inventor: Anna Chagnaud, 18bis lle de Migneaux, F-78300 Poissy (FR)

( * ) Notice: Subject to any disclaimer, the term of this patent is extended or adjusted under 35 U.S.C. 154(b) by 0 days.

(21) Appl. No.: 10/558,065

(22) PCT Filed: May 21, 2004

(86) PCT No.: PCT/FR2004/001260

§ 371 (c)(1),
(2), (4) Date: Apr. 17, 2006

(87) PCT Pub. No.: WO2004/106620

PCT Pub. Date: Dec. 9, 2004

(65) Prior Publication Data

US 2006/0248755 A1 Nov. 9, 2006

(30) Foreign Application Priority Data

May 23, 2003 (FR) ..... 03 06210
Nov. 28, 2003 (FR) ..... 03 13986

(51) Int. Cl.
*D06F 81/10* (2006.01)
*D06F 81/00* (2006.01)

(52) U.S. Cl. ..... 38/138

(58) Field of Classification Search ..... 38/15, 38/52, 103, 135, 137, 138, 139, 140; 108/59, 108/92

See application file for complete search history.

(56) References Cited

U.S. PATENT DOCUMENTS

| | | | | | |
|---|---|---|---|---|---|
| 613,437 | A | * | 11/1898 | Babcock, Jr. | 108/97 |
| 955,526 | A | * | 4/1910 | Miller | 38/135 |
| 1,054,721 | A | * | 3/1913 | Simon | 38/52 |
| 1,729,353 | A | * | 9/1929 | Mitkoff | 38/103 |
| 2,721,407 | A | * | 10/1955 | Sutherland | 108/121 |
| 2,810,971 | A | | 10/1957 | Berlepsch et al. | |
| 3,229,393 | A | * | 1/1966 | Kroenke | 38/135 |
| 4,543,739 | A | * | 10/1985 | Zerhoch et al. | 38/15 |
| 4,903,421 | A | | 2/1990 | Saito | |
| 6,655,055 | B2 | * | 12/2003 | Loger et al. | 38/137 |

FOREIGN PATENT DOCUMENTS

| | | |
|---|---|---|
| DE | 92 07 010 | 7/1992 |
| EP | 1 033 432 | 9/2000 |
| FR | 573 236 | 6/1924 |
| FR | 2 695 145 | 3/1994 |
| GB | 2 069 627 | 8/1981 |
| NL | 1 008 299 | 8/1999 |

* cited by examiner

*Primary Examiner*—Ismael Izaguirre
(74) *Attorney, Agent, or Firm*—Young & Thompson

(57) ABSTRACT

An ironing board, includes a plate (2) which may be driven in rotation about an axis. The plate (2), mounted on a fixed base (4) housed directly below the plate (2) has an essentially circular form with at least one part essentially angular in form (3). The above is of application to ironing boards.

2 Claims, 6 Drawing Sheets

IRONING BOARD

The present invention relates to an ironing board of the type comprising a plate that can be driven in rotation about an axis.

Conventional ironing boards are generally mounted on foldable crossed legs and generally require the user to assume a standing position. Moreover, a board has a relatively narrow width of about 40 cm, which requires the user to move his iron several times to reposition a piece to be ironed of larger dimensions.

As a result, these ironing boards cause physical fatigue both because they require a standing position for ironing and also because they give rise to manipulation of the iron which must be applied and raised numerous times. Moreover, it is not possible to separate the board from the legs to be able to install the board on a receiving surface in another location such as the garden.

There is known from FR-A-2 695 145, an ironing board which, to limit the physical fatigue of the user, proposes to be able to iron in a seated position. Thus, the ironing board of conventional shape, which is to say rectangular with a pointed end, is mounted pivotably 360° about an axis and also comprises drive means for longitudinal movement of the board relative to the legs. It this manner, the user can sit and make different movements in this position to move the board longitudinally and to make a turn.

However, such a board has other drawbacks. In particular, the turned board whilst remaining in a seated position, it is necessary to slide the board longitudinally before turning it because of its size. Such an ironing board thus remains difficult to handle. Moreover, the ironing board described still has a conventional shape, which, during ironing, requires repositioning the piece to be ironed several times and hence to apply and raise several times the iron.

Similarly, there is known from JP-A-09052000, an ironing board provided with a circular board having a central axis that can rotate about the vertical axis of a base. Such an ironing board has a large drawback connected with its size. Thus, once the axis of the plate is engaged with the axis of the base, there is an ironing board having the size of a furniture table. Moreover, if the board is disassembled to store it, there remains the problem of the size of the base. Moreover, the base is present in the form of a tubular ring of uncertain stability during ironing or during driving in rotation of the table.

The present invention thus seeks to overcome these drawbacks by providing an ironing board which permits ironing a piece to be ironed without having the need to apply and raise the iron numerous times to reposition the piece and which also permits ironing a piece to be ironed by limiting the movements of the user whilst having a relatively small size and the ability to be stored.

To this end, the present invention has for its object an ironing board comprising a plate that can if desired be driven in rotation about an axis, characterized in that this board, mounted on a fixed base disposed directly beneath said board, has essentially circular shape having moreover at least one substantially angular portion.

Preferably, an ironing board according to the invention permits easy ironing because the essentially circular shape and the dimensions of said board permits a piece to be ironed such as a napkin, a t-shirt, a tea towel, etc., completely extended whilst the presence of the angular angles serves to reinforce the positioning of shirts, t-shirts, etc. The manipulations of the iron are thus limited, which would otherwise be required by the movement of the piece to be ironed.

Preferably, the plate is movable and drivable in rotation about the central axis of the fixed base disposed directly beneath the board.

Thus, the mobile board permits having access to all portions of this extended piece to be ironed without manipulation other than driving in rotation said movable board, relative to the fixed base. It is thus not necessary to apply the iron and then take it up to reposition the piece to be ironed as was previously the case.

An ironing board according to the present invention can be directly used by positioning on a receiving surface such as a kitchen table, dining room table, on trestles and other like supports such as a conventional base. As a result, its size remains limited because storage is easily carried out, the board and the fixed base are secured to each other and are stored together whilst, for example, the conventional legs of an ironing board are stacked for storage.

Preferably, the ironing board according to the invention has a diameter of about 1 meter, thereby offering a surface for reception of the piece to be ironed that is sufficient to spread out most clothing articles and articles of household linen.

Preferably, the movable board is freely mounted for rotation about the central axis of the fixed base, the driving in rotation of the movable board taking place manually by the user.

The base can be in the form of a second board of dimensions substantially identical to the movable board or else can have any other suitable shape to constitute this fixed base. In particular, the base is shaped with a bottom and sidewalls of a housing, of which the movable board forms the cover.

Preferably, the movable board and/or the fixed base comprise means for mounting, the driving in rotation of the movable board relative to the fixed base, such as rollers, sliding strips and the like.

Preferably, there can also be provided blocking means permitting immobilizing the movable board relative to the fixed board by pressure of the movable board on the fixed base.

Thus, the board turns instantaneously and rapidly under the force of the hand of the user but is immobilized as soon as pressing begins and without extra pressure on the iron.

According to an embodiment of the invention, the driving in rotation of the movable board can be carried out by mechanical drive means such as rack and pinions, belt and toothed wheel, controlled by electrical or pneumatic means or other suitable means.

Thus preferably, it can also be obtained thanks to electrical control, a variable speed of rotation of the movable board. Thus, the user when ironing can also turn the movable board to obtain dynamic pressing, the speed of rotation adding to the speed of movement of the person who irons.

The ironing board according to the invention can be made of any ferrous alloy, non-ferrous alloy or aluminum alloy, of stainless steel, steel, wood, composite material or any other suitable materials.

Preferably, a steam device or suction device can be incorporated below the movable board, preferably between the fixed spaced and said board.

According to a first embodiment of the invention, the board is completely circular and comprises thus moreover a substantially angular portion projecting from the circular board and corresponding substantially to the pointed portion of a conventional ironing board.

According to a second embodiment of the invention, the board has an essentially circular shape but comprises moreover at least one angle equal to or greater than 90°.

According to a modified embodiment, the angle of the board is a right angle. This angle can be of one piece with the board or else can be added to a board of circular shape.

This right angle permits pressing shirts on the right side or the left side and on the front without too much movement. It also permits better positioning of the shirts.

According to a second modified embodiment, the board has a truncated ellipsoidal shape, which is to say that the board has an essentially circular shape provided with four angles greater than 90°, of about 100 to 120°.

The dimensions of the board are thus selected in a suitable manner such that the width of the board, which has a substantially rectangular appearance, corresponds substantially to a width of the back of shirts. Thus, the shirt once positioned on the right side, once on the left side and once on the back, can be ironed with a single stroke, whilst for conventional ironing boards, the front side as well as the back must be positioned respectively at least four times.

Such a board preferably permits ironing seated or standing, with a fixed board or one movable in rotation, and receives pieces most often ironed such as t-shirts, shirts, towels, napkins, tablecloths or draperies already folded.

According to a third modified embodiment, the ironing board according to the invention comprises two angles greater than 90°, said board thus having substantially two portions, one corresponding to a semi-circle and the other having a U shape whose base is rounded.

This form of ironing board is particularly is advantageous for pressing pieces such as shirts. The angle formed between the base of the U and a wing of this latter serves as a reference to position a shirt.

The invention will now be described in greater detail with reference to the drawings, in which.

Figure 6:
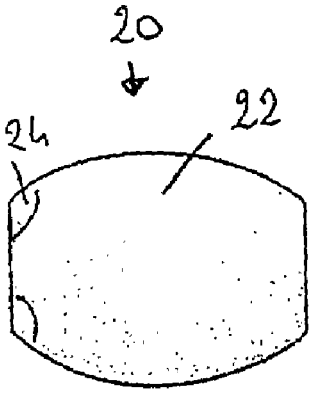
Figure 6G:
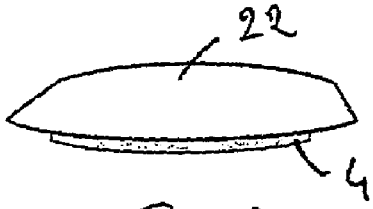
Figure 6A:
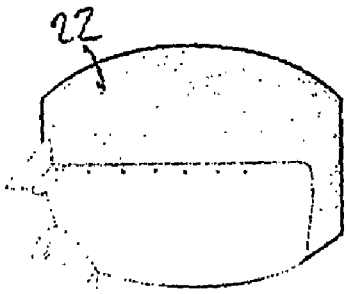
Figure 6B:
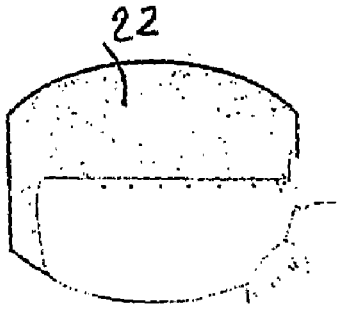
Figure 6C:
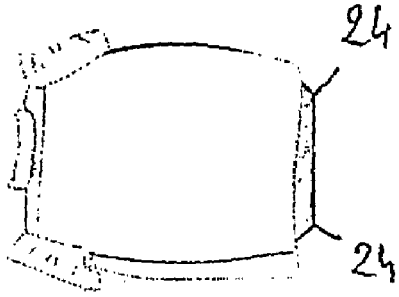
Figure 6D:
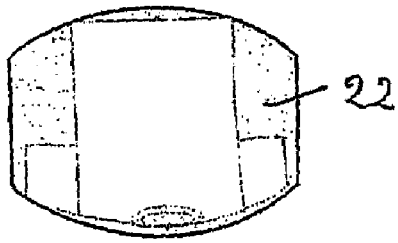
Figure 7:
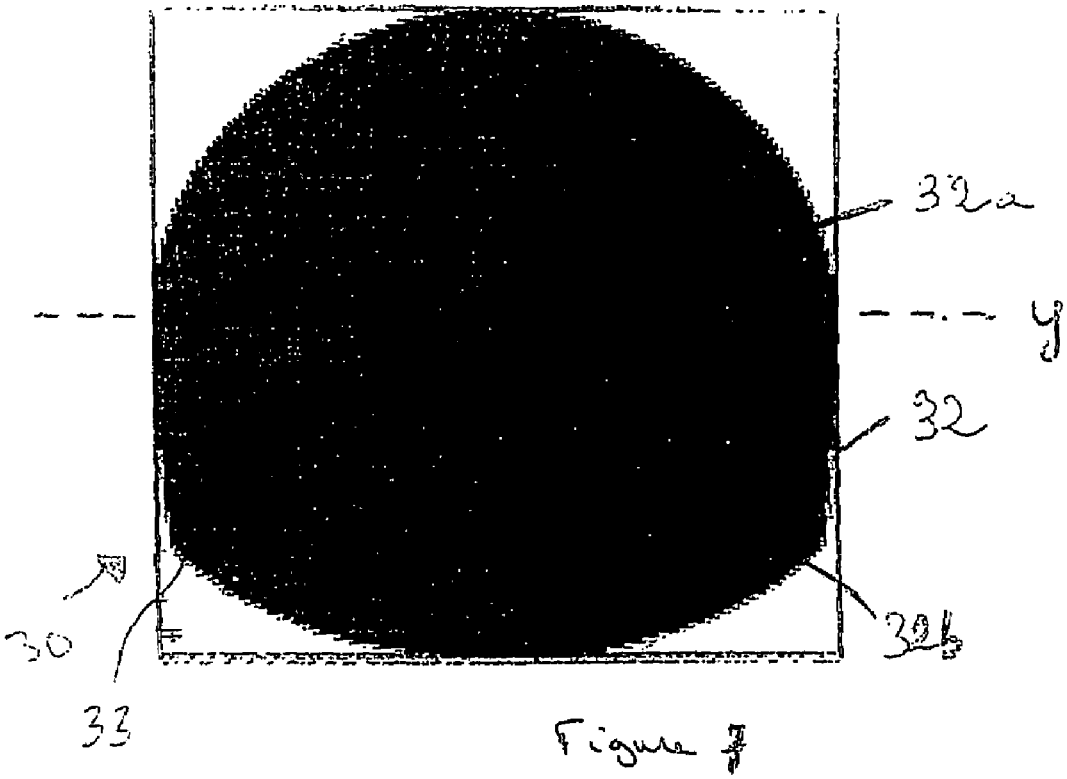

FIGS. 6, 6*a*, 6*b*, 6*c*, 6*d*, 6*e* and 6*f* are plan views of preferred modified embodiments of the second embodiment of the invention;

FIG. 6*g* is a perspective view from the side of the modification of FIG. 6;

FIG. 7 is a top plan view of a third embodiment of the invention; and

Figure 8:
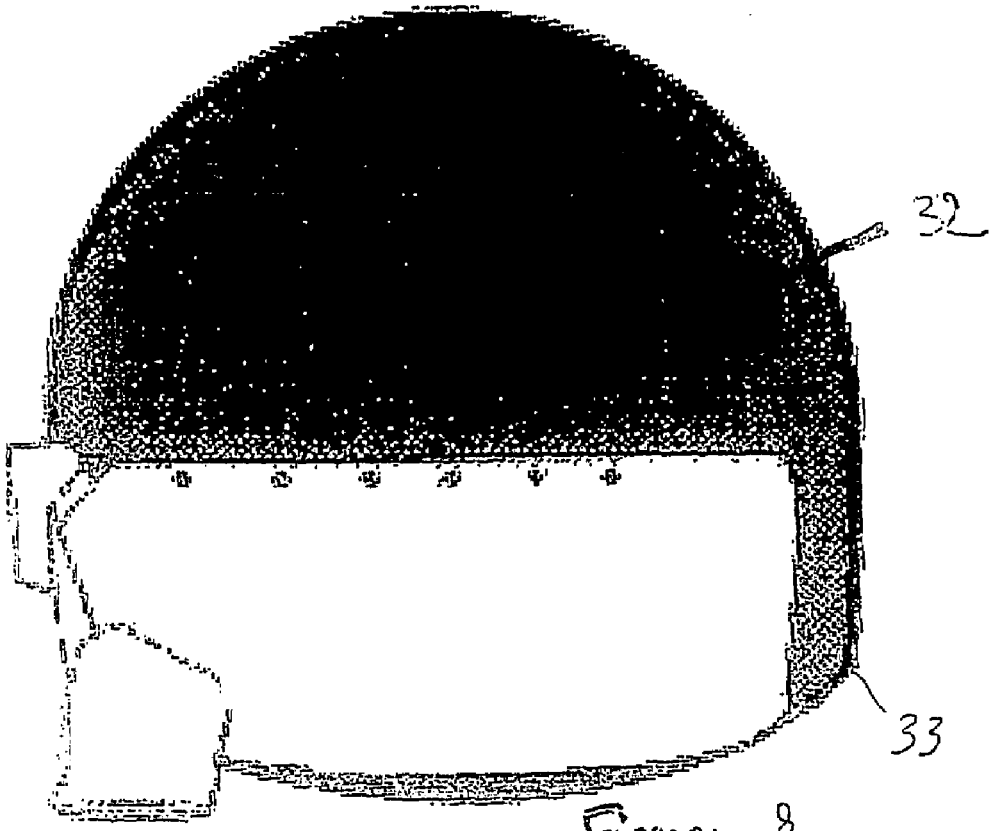

FIG. 8 is a top plan view of FIG. 7 in use.

Figure 1:
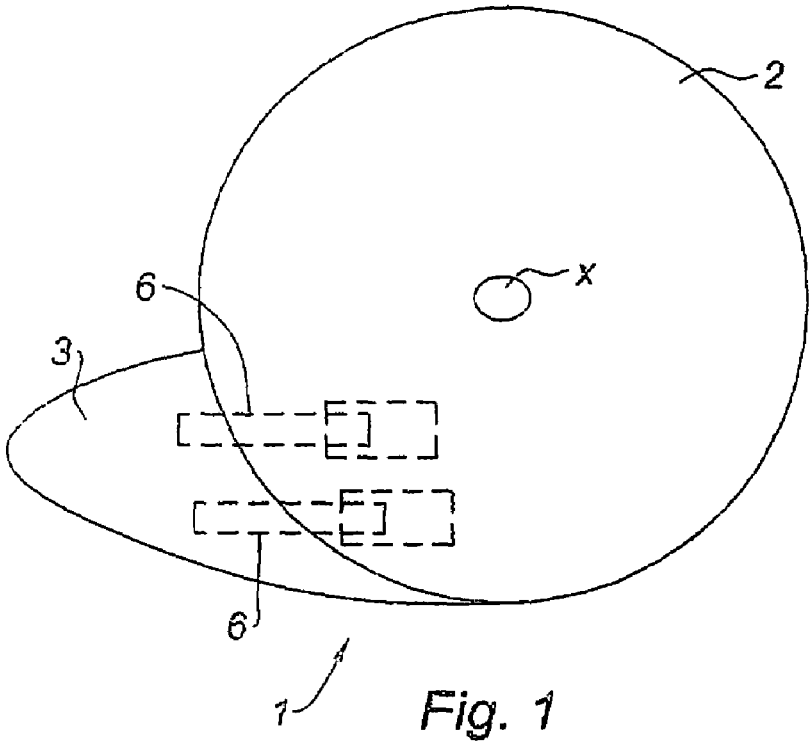
FIG. 1 is top plan view of a first preferred embodiment of an ironing board according to the invention.
Figure 3:
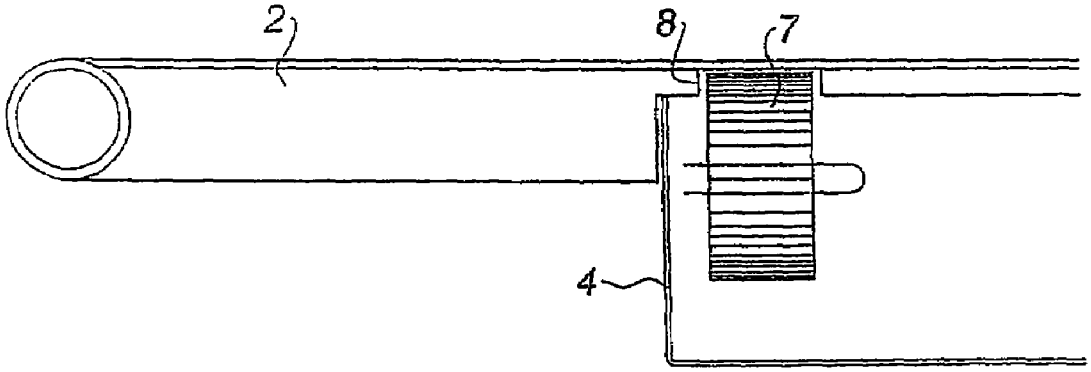
FIG. 3 is a cross-sectional view of a detail of the board according to FIG. 1.

As can be seen in FIG. 1, the ironing board 1 has a board 2 of circular shape as well as a portion 3 that projects from said board 2 and has the form of the pointed end of a conventional ironing board.

Figure 2:
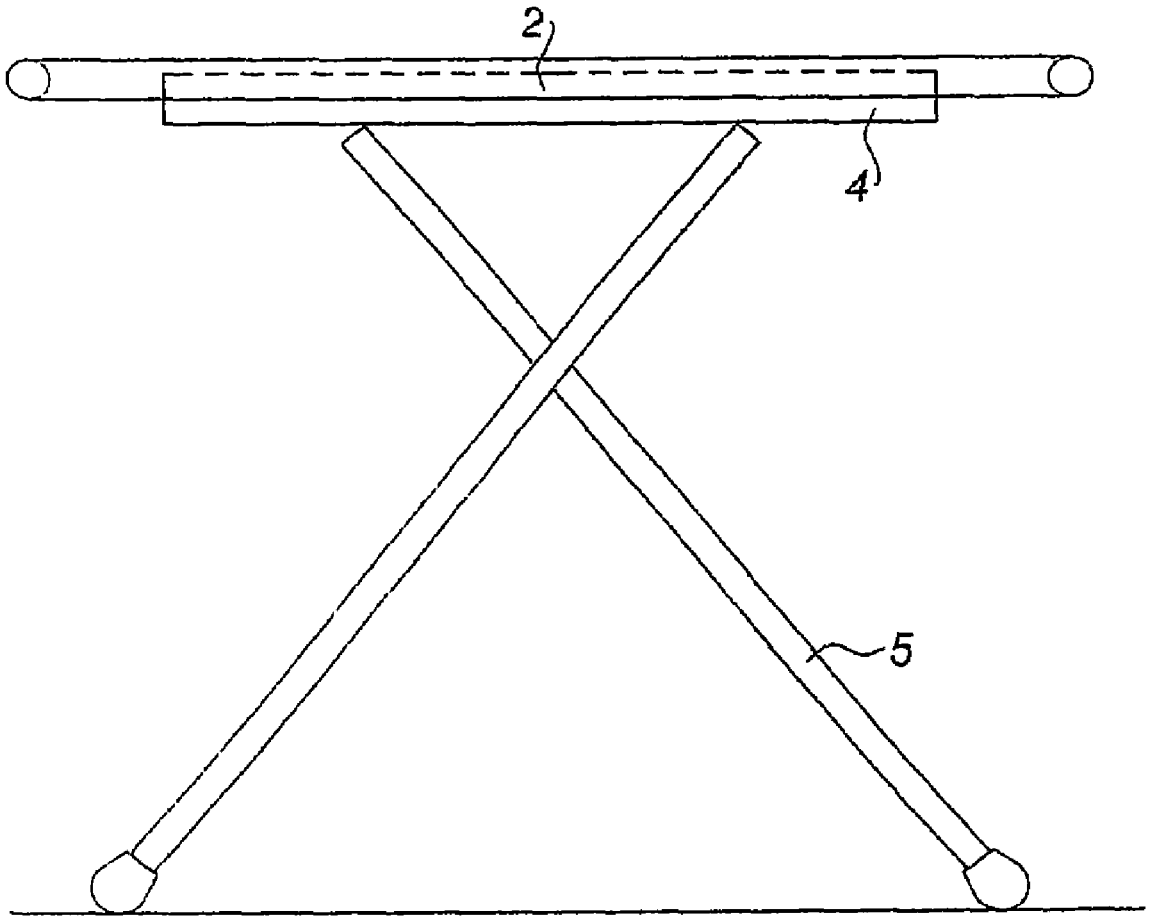
FIG. 2 is a side perspective view of an ironing board according to FIG. 1.

The board 2 is a not drivably in rotation relative to the central axis x of a fixed base 4 of the ironing board. This base 4 can be mounted on conventional legs 5 of an ironing board, as shown in FIG. 2, or else can be formed like a base which can be rested directly on a receiving surface such as a kitchen table, for example. The base 4 is present in the form of a second board substantially identical to the movable board 2.

Preferably, the movable board 2 has perforations permitting the passage of steam when a steam iron is used.

The pointed portion 3 can be mounted retractably on the base board 2, for example slidably on rails 6 as can be seen in FIG. 1.

Figure 4:
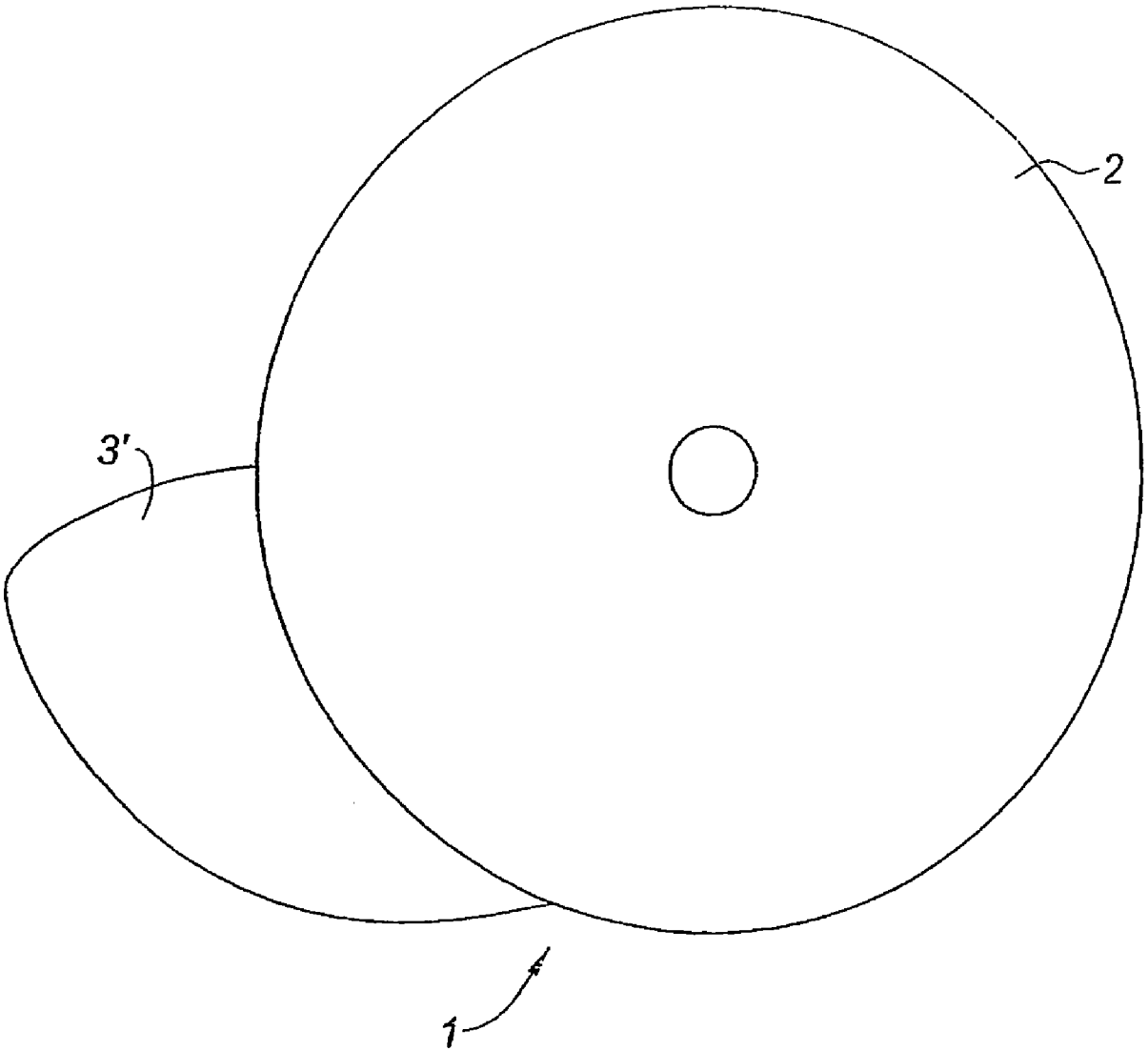
FIG. 4 is a modified embodiment of an ironing board according to FIG. 1.

A modification of this pointed portion 3' is shown in the ironing board 1 of FIG. 4.

So as to facilitate driving in rotation the movable board 2 relative to the fixed base 4, said movable board can comprise rollers 7 engaged in a circular groove 8 provided in the fixed based 4.

Figure 5:
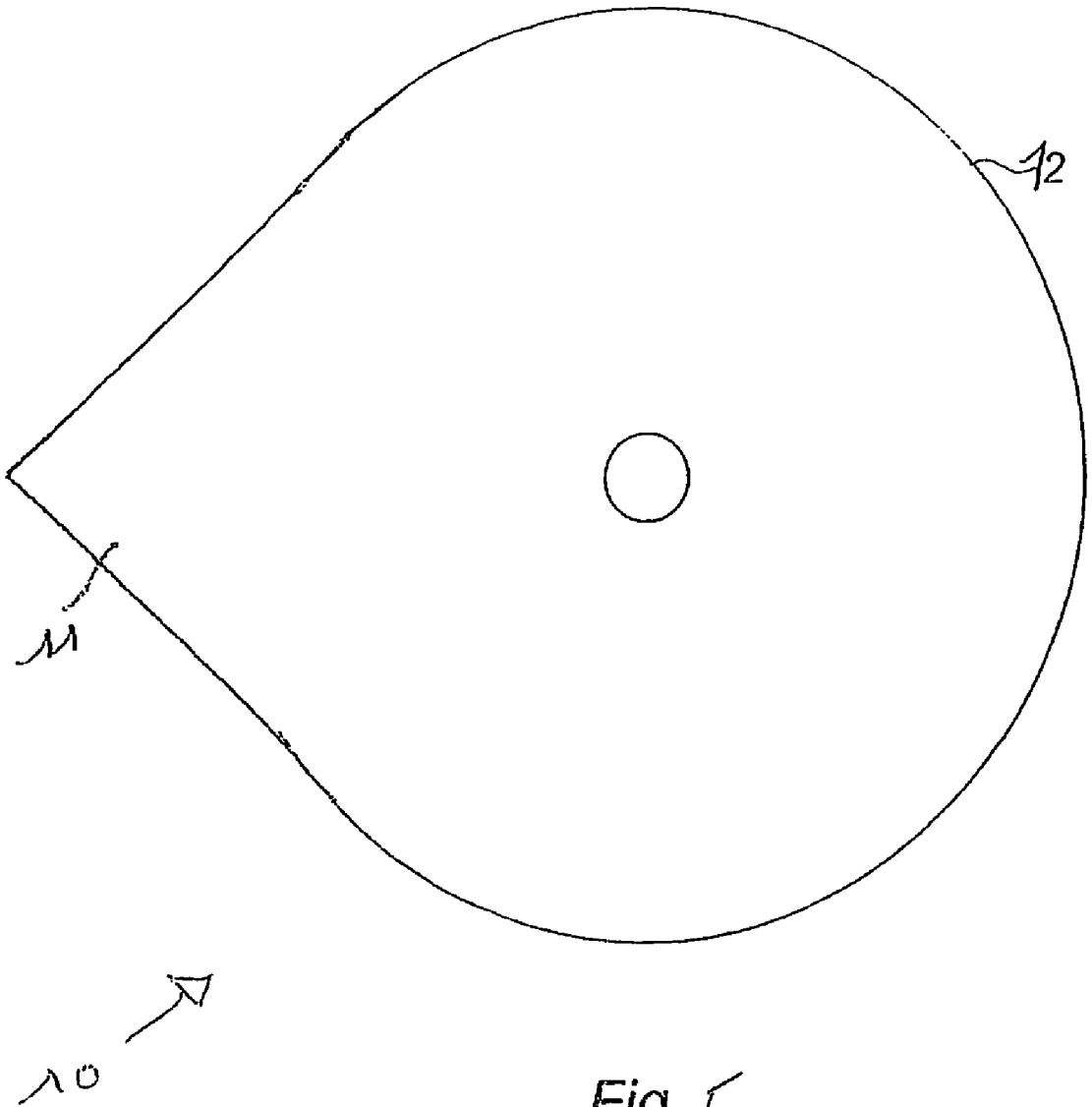
FIG. 5 is a top plan view of a second embodiment of the invention.

In the embodiment shown in FIG. 5, the ironing board 10 comprises a board 12 of essentially circular shape, which has moreover an angle 11. This angle 11 is preferably a right angle. This right angle permits pressing shirts on the right or left side, on the front without too much movement. It also permits a better positioning of the shirts. This angle 11 is formed of one piece with the board 12.

In the embodiment shown in FIGS. 6 to 6*g*, the ironing board 20 comprises a board 22 in the form of a truncated ellipse with four angles 24 of about 100 to 120°, fixed or drivable in rotation, relative to a fixed base 4.

The shape and dimensions of a said board are thus preferably selected to permit the reception of a piece to be ironed such as a towel, a t-shirt (FIG. 6*d*), a tea towel, etc., completely extended whilst the presence of the angle serves as a reference for positioning of shirts. (FIG. 6*a*, 6*b*), of t-shirts, etc. There are thus limited the manipulations of the iron, otherwise required by the movement of the piece to be ironed. This embodiment is thus very interesting when the width of the board corresponds substantially to the width of the back of shirts (FIG. 6*c*) or t-shirts.

Figure 6E:
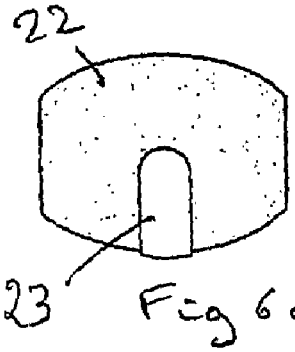
Figure 6F:
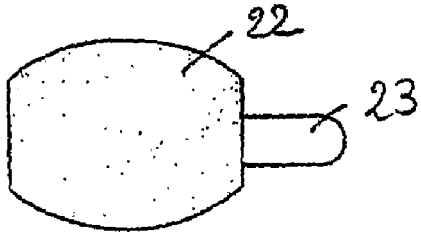

A sleeve board 23 is emplaced on this board 20 in different ways shown in FIGS. 6*e* and 6*f*. It preferably has a length and width permitting sliding a shirt sleeve over it for its ironing, or a skirt or trousers tops.

In FIGS. 7 and 8 is shown a third embodiment of a board 30 according to the invention. The board 32 is constituted by two portions virtually separated by an axis y, one corresponding to a half-circle 32*a* and the other 32*b* having a U shape whose base is rounded, with two angles of about 120°.

This form is particularly advantageous to press shirts as shown in FIG. 8.

Accessories such as a support for the iron, for the sleeve board and the like can be fixed either on the fixed base 4, for example retractably below, or on the movable board 2, 12, 22, 32.

The invention claimed is:

1. Ironing board comprising a board that can be driven in rotation about an axis, said board (2, 12, 22, 32) being mounted on a fixed base (4) disposed directly beneath said board (2, 12, 22, 32), in order that it can be directly used by positioning it on a receiving surface, said board having an essentially circular shape having moreover at least one substantially angular portion (3, 3'), said substantially angular portion(3, 3') projecting from the board (2) corresponding to the pointed portion of a conventional ironing board, wherein the pointed portion (3, 3') is mounted retractably below the board (2).

2. Ironing board according to claim 1, wherein said pointed portion (3, 3') is mounted below the board (2) slidably on rails (6).

* * * * *